United States Patent [19]

Carlson et al.

[11] 4,019,854

[45] Apr. 26, 1977

[54] DIRECT SPARK IGNITION SYSTEM UTILIZING GATED OSCILLATOR

[75] Inventors: Elmer A. Carlson, Agoura; Joseph G. Raffaelli, Granada Hills; Ronald A. Gann, La Crescenta, all of Calif.

[73] Assignee: International Telephone and Telegraph Corporation, New York, N.Y.

[22] Filed: Feb. 27, 1976

[21] Appl. No.: 661,938

[52] U.S. Cl. ..... 431/80; 431/69; 431/78

[51] Int. Cl.[2] ..... F23H 5/12

[58] Field of Search ..... 431/80, 79, 78, 66, 431/67, 254, 69; 307/106; 317/96

[56] References Cited

UNITED STATES PATENTS

| | | | |
|---|---|---|---|
| 3,439,991 | 4/1969 | Fathauer | 431/80 X |
| 3,938,938 | 2/1976 | Carlson | 431/78 |

*Primary Examiner*—Edward G. Favors
*Attorney, Agent, or Firm*—A. Donald Stolzy

[57] ABSTRACT

A system for trial period ignition of a fluid fuel burner having an oscillator with a gate in the feedback path thereof, the oscillator providing power to a burner fuel valve and to a spark generator, wherein oscillator operation is sustained after the period only upon flame detection which keeps the oscillator feedback path gate closed.

2 Claims, 2 Drawing Figures

DIRECT SPARK IGNITION SYSTEM UTILIZING GATED OSCILLATOR

BACKGROUND OF THE INVENTION

This invention relates to fluid fuel combustion apparatus, and more particularly to a fail safe pilotless direct spark ignition system therefor.

In the past, oscillators have been employed in direct spark ignition systems. For example, see U.S. Pat. No. 3,853,455. However, such oscillators have been powered by current rectified by a flame rod.

SUMMARY OF THE INVENTION

In accordance with the system of the present invention, the above-described and other disadvantages of the prior art are overcome by providing a gated oscillator which is sustained in operation by a flame sensor. The gate thus requires little or no current or power to cause the oscillator to oscillate, which was not the case in the prior art.

The above-described and other advantages of the present invention will be better understood from the following detailed description when considered in connection with the accompanying drawings.

BRIEF DESCRIPTION OF THE DRAWINGS

In the drawings which are to be regarded as merely illustrative.

DESCRIPTION OF THE PREFERRED EMBODIMENT

Figure 1:
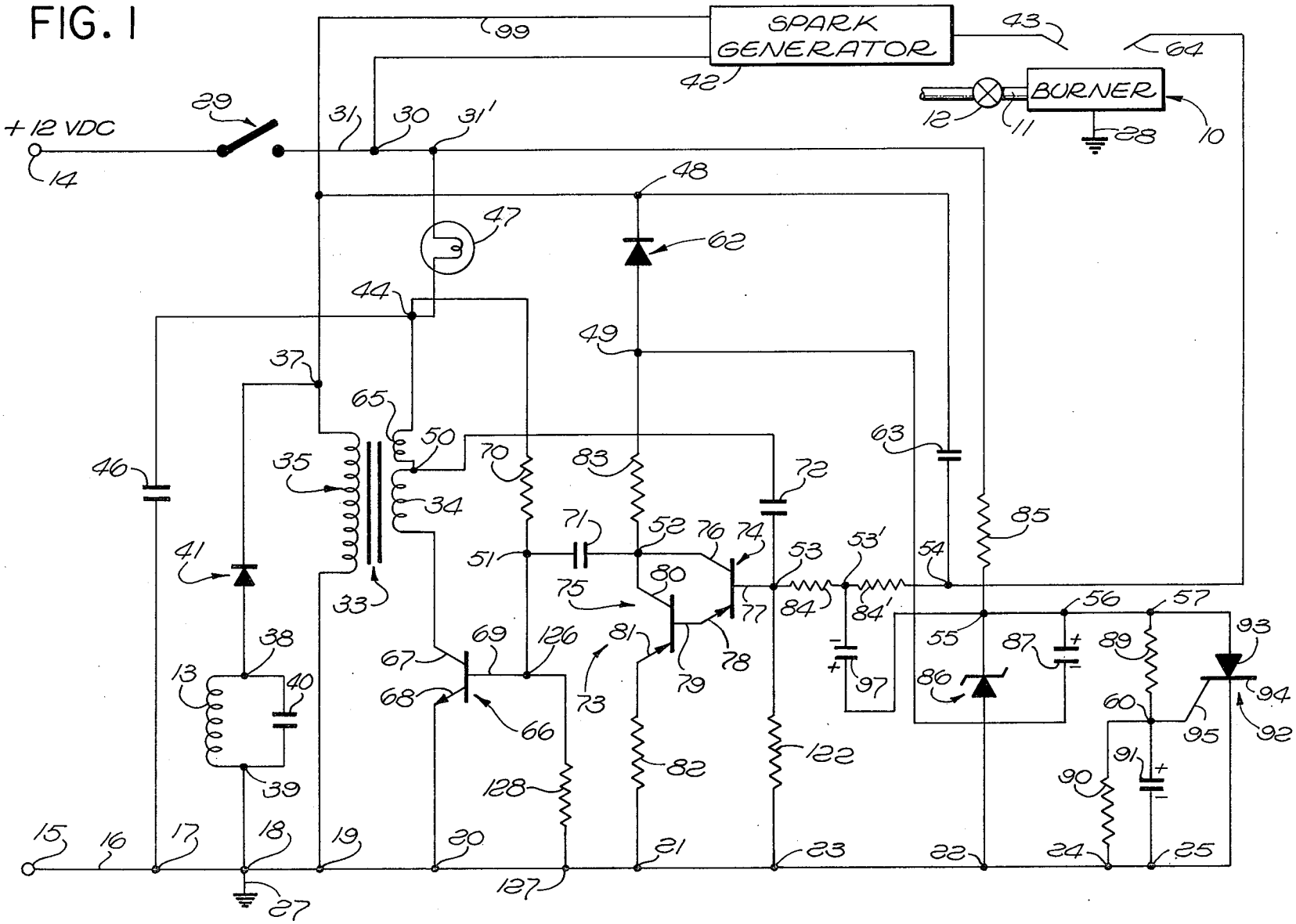
FIG. 1 is a schematic diagram of a direct spark ignition system constructed in accordance with the present invention.

In accordance with the present invention, a heating device may be employed including a gas burner 10 as shown in FIG. 1 having a gas inlet 11 connected from a valve 12. Valve 12 is a solenoid valve having a solenoid winding illustrated at 13.

The circuit of FIG. 1 is provided with input terminals 14 and 15, terminal 14 being positive with respect to terminal 15.

A lead 16 is connected from terminal 15 through junctions 17, 18, 19, 20, 127, 21, 22, 23, 24 and 25. Junction 18 is grounded at 27. Similarly, burner 10 is grounded at 28.

A thermostatic or other switch 29 is connected from junction 14 to a junction 30. A lead 31 is connected from switch 29 through junction 30, and a junction 31'.

A transformer is provided at 33 having a primary 34 and a secondary 35. The upper end of secondary 35 is connected to a junction 37.

Junctions are provided at 38 and 39. A capacitor is provided at 40. Winding 13 and capacitor 40 are connected in parallel between junctions 38 and 39. Junctions 18 and 39 are connected together. A diode 41 is connected from junction 38 to junction 37 and poled to be conductive in a direction toward junction 37.

A spark generator 42 is connected from junction 37 to a spark electrode 43.

Junction 44 is connected from junction 17 through a capacitor 46. A lamp 47 is connected between junctions 31' and 44.

The lower end of transformer secondary 35 is connected to junction 19.

Junctions are provided at 48, 49, 50, 51, 52, 53, 54, 55, 56, 57, 60 and 126.

A diode 62 is connected from junction 49 to junction 48 and poled to be conductive in a direction toward junction 48. A capacitor 63 is connected between junctions 48 and 54. A conventional flame rod 64 is connected from junction 54. A winding 65 is connected between junctions 44 and 50. An amplifier including a transistor 66 is provided, transistor 66 including a collector 67, an emitter 68 and a base 69, transformer primary 34 being connected from junction 50 to collector 67, emitter 68 being connected to junction 20. A resistor 70 is connected from junction 44 to junction 51. Base 69 is connected from junction 51. Feedback to the amplifier is provided through a capacitor 71 and a capacitor 72. Capacitor 71 is connected between junctions 51 and 52. Capacitor 72 is connected between junctions 50 and 53. A conventional Darlington circuit 73 is provided including a transistor 74 and a transistor 75. Transistor 74 has a collector 76 connected from junction 52. Transistor 74 has a base 77 connected to junction 53. Transistor 74 has an emitter 78 connected to a base 79 of transistor 75. Transistor 75 also includes a collector 80 connected from junction 52, and an emitter 81. A resistor 82 is connected from emitter 81 to junction 21. A resistor 83 is connected between junctions 49 and 52. Resistors 84 and 84' are connected between junctions 53, 53' and 53', 54, respectively. A resistor 85 is connected between junctions 31' and 55. A zener diode 86 is connected between junctions 22 and 55. A capacitor 87 is connected between junctions 56 and 49. Junctions 55, 56 and 57 are connected together.

A resistor 122 is connected between junctions 53 and 23. A resistor 128 is connected between junctions 126 and 127, junctions 51 and 126 being connected together and to base 69.

A resistor 89 is connected between junctions 57 and 60. A resistor 90 is connected between junctions 24 and 60. A capacitor 91 is connected between junctions 25 and 60.

A silicon controlled rectifier (SCR) is provided at 92 including an anode 93, a cathode 94 and a gate 95. Anode 93 is connected from junction 57. Cathode 94 is connected to junction 25. Gate 95 is connected from junction 60.

OPERATION

In the operation of the direct spark ignition system of the present invention illustrated in FIG. 1, spark generator 42 may, if desired, be entirely conventional. Spark generator 42 may be provided with an input lead 99 connected from junction 37 over which, during trial ignition, an A.C. signal is provided which is rectified and doubled or tripled in spark generator 42, stored in a capacitor and discharged from electrode 43 to burner 10 in the conventional way.

Trial ignition of burner 10 takes place when switch 29 is closed by a thermostat, manually or otherwise. When switch 29 is closed, capacitors 87 and 97 begin to charge. The same is true of capacitor 91. When capacitor 91 charges to a sufficient degree, SCR 92 fires. Since junction 25 is at ground potential, when SCR 92 fires, junction 27 is automatically tied into ground potential. This means that junction 56 is at ground potential, and that junctions 49 and 53' are at a potential below ground potential (capacitor 97 having been charged with the polarity shown in FIG. 1). The same is true of the charging polarities of capacitors 87 and 91.

In accordance with the foregoing, the potential of junction 53 is negatively driven. The same is true of the potential of junction 49. This causes the oscillator to oscillate. The base 77 of transistor 74 requires a negative bias. Note that the transistors 74 and 75 are PNP type transistors.

The general circuit of the oscillator includes the transistor 66 having the feedback from junction 50 through capacitor 72 to the base 77 of transistor 74. The Darlington circuit then, acting as a gate, transmits the signal fed back through capacitor 71 to the base 69 of transistor 66.

When the charges on capacitors 87 and 97 finally fall to zero, the oscillator will no longer oscillate because a proper negative bias is not then supplied to transistor base 77. However, if burner 10, during trial ignition, is in fact ignited by spark generator 42, flame rod 64 will act to build up a charge upon capacitor 63, which will turn the Darlington circuit or gate on and sustain oscillator oscillations.

During trial ignition, winding 13 of valve 12 is energized and gas enters burner 10. If ignition is achieved, valve 12 thus remains open. If ignition is not achieved, the oscillator will no longer oscillate, winding 13 will not be energized, valve 12 will be closed, and burner 10 will no longer receive any gas or fluid fuel.

Figure 2:
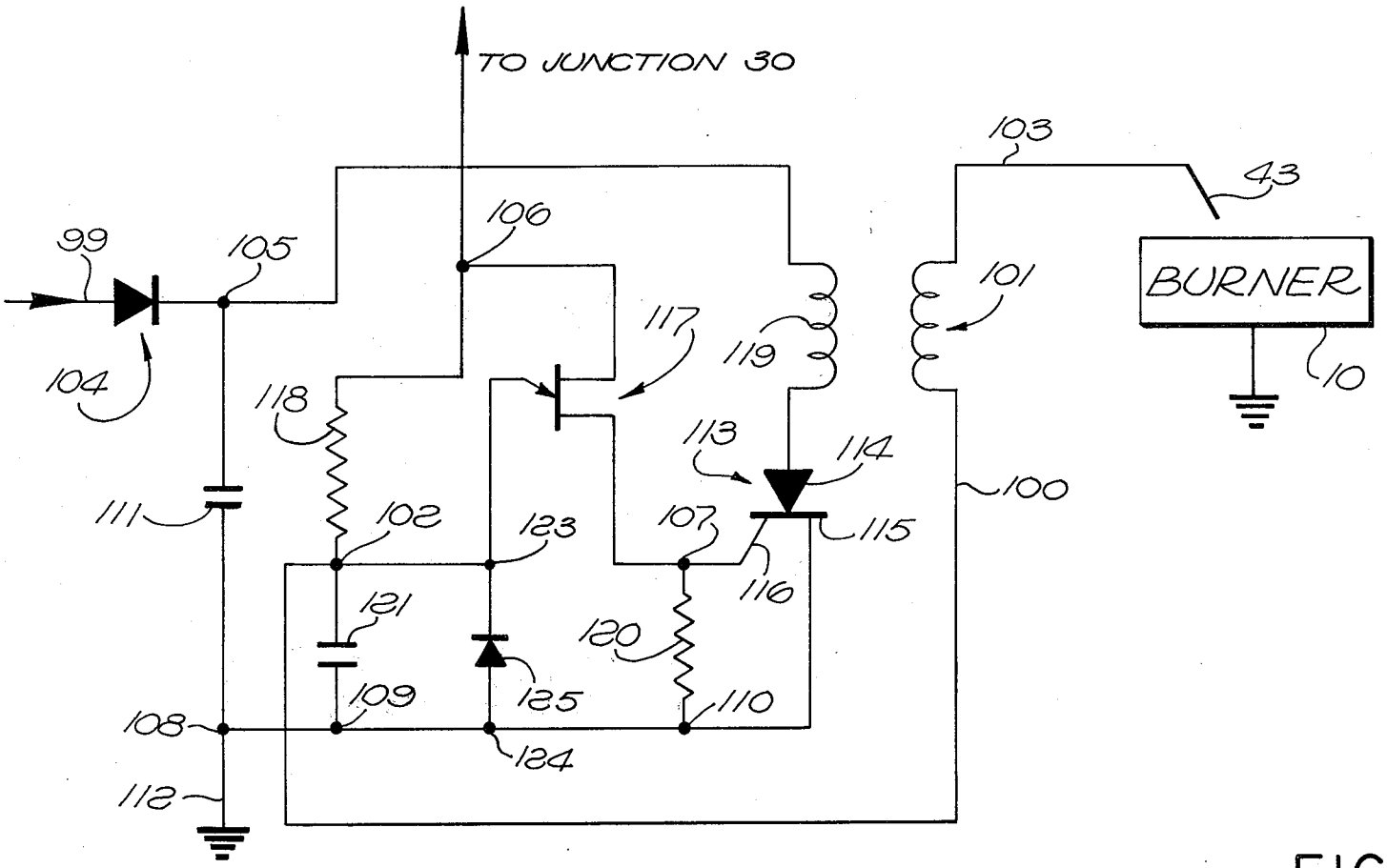
FIG. 2 is a schematic diagram of a spark generator illustrated in FIG. 1.

Spark Generator 42 is shown in greater detail in FIG. 2. In the construction of FIG. 2, as is conventional, spark generator 42 will not supply sparks to burner 10 via electrode 43 after ignition. This is true because one lead 100 of a transformer secondary 101 is connected to a junction 102 while the other lead 103 thereof is connected to electrode 43. A diode 104 rectifies the signal appearing at one lead 99, and is connected in series therewith and connected to be conductive toward a junction 105. Junctions 30 and 106 are connected together. Junctions 107, 108, 109 and 110 are additionally provided. A storage capacitor 111 is connected between junctions 105 and 108, junction 108 being grounded at 112. Junctions 108, 109 and 110 are also connected together. An SCR 113 is provided having an anode 114, a cathode 115 and a gate 116. A unijunction transistor 117 fires SCR 113. A resistor 118 is connected between junctions 102 and 106. A transformer primary 119 is connected from junction 105 to anode 114. Cathode 115 is connected to junction 110. Gate 116 is connected to junction 107. A resistor 120 is connected between junctions 107 and 110. A capacitor 121 is connected between junctions 102 and 109.

The spark generator 42 of FIG. 2 also includes junctions 123 and 124 connected respectively from junctions 102 and 109. A diode 125 is connected between junctions 124 and 123, and poled to be conductive in a direction toward junction 123.

The operation of the spark generator 42 shown in FIG. 2 is as follows. The A.C. voltage impressed upon diode 104 is rectified thereby. Capacitor 111 stores the rectified charge.

SCR 113 then fires at a delayed time based upon the time of firing of unijunction transistor 117, which is connected to SCR gate 116. The time of firing of the unijunction transistor 117 is determined by the potential of junction 102, this potential increasing with the flow of current through resistor 118 until it reaches the firing value of the emitter of unijunction 117. In other words, the firing time of transistor 117 is based upon the charging time of capacitor 121.

When transistor 117 fires, SCR 113 is gated on. Capacitor 111 then discharges through transformer primary 119, and a spark from electrode 43 to burner 10 ignites the burner 10. Once ignition has taken place, a high resistance ground also is produced between electrode 43 and the ground of burner 10, which ground is produced to effect an A.C. ground from junction 102 through capacitor 121. This is for discharge. There is also a D.C. resistance placed in parallel with capacitor 121 which prevents it from charging. For this reason, transistor 117 cannot continually fire and fire SCR 113. The connection of lead 100 to junction 102 thus disables the spark generator 42 when burner 10 has been ignited.

What is claimed is:

1. A direct spark ignition system, said system comprising: a fluid fuel burner; an electrically operable valve connected to said burner to control the fuel admitted thereto; an oscillator; a timing circuit actuable to cause said oscillator to oscillate for a predetermined period; a spark generator connected from said oscillator to ignite fuel emanating from said burner; and a flame sensor to sustain oscillations of said oscillator after said period when a flame exists at said burner, said oscillator including an amplifier having a feedback path with a gate connected therein, said flame sensor being connected to said gate to cause the same to close and to complete said feedback path in manner to cause said oscillations to be sustained after said period when a flame exists at said burner, said flame sensor holding said gate open in the absence of flame to allow said oscillations to die out.

2. The invention as defined in claim 1, wherein said gate is a Darlington circuit having an input transistor with an input base, said flame sensor including a capacitor and a flame rod connected from said oscillator to a location over said burner, said capacitor being connected to said input transistor base to close said gate after said period when a flame exists between said burner and said flame rod and to open said gate when no such flame exists after said period.

* * * * *